US011479980B1

(12) United States Patent
Gregory et al.

(10) Patent No.: US 11,479,980 B1
(45) Date of Patent: Oct. 25, 2022

(54) SIDING INSTALLATION GAUGE

(71) Applicant: Catherine A. Gregory, Gold Beach, OR (US)

(72) Inventors: Catherine A. Gregory, Gold Beach, OR (US); Leonard Cramer, Gold Beach, OR (US)

(73) Assignee: Catherine A. Gregory, Gold Beach, OR (US)

( * ) Notice: Subject to any disclaimer, the term of this patent is extended or adjusted under 35 U.S.C. 154(b) by 538 days.

(21) Appl. No.: 16/590,365

(22) Filed: Oct. 1, 2019

Related U.S. Application Data

(60) Provisional application No. 62/766,070, filed on Oct. 1, 2018.

(51) Int. Cl.
*E04F 21/18* (2006.01)
*E04F 13/08* (2006.01)

(52) U.S. Cl.
CPC ..... *E04F 21/1855* (2013.01); *E04F 13/0803* (2013.01); *Y10S 52/01* (2013.01); *Y10S 269/904* (2013.01)

(58) Field of Classification Search
CPC . E04F 21/1855; E04F 21/0864; E04F 21/185; E04F 21/1877; Y10S 269/904; Y10S 52/01; E04D 15/04; E04D 15/025; B25B 5/068; B25B 27/14; B25B 3/00; B25B 5/00; B25B 5/02; B25B 5/04; B21B 1/205
USPC ..... 33/647, 648, 649, 646; 269/904; 52/DIG. 1; 81/45
See application file for complete search history.

(56) References Cited

U.S. PATENT DOCUMENTS 332,323 A * 12/1885 Brand ..... E04F 21/1855 33/646
354,680 A * 12/1886 Vollrath ..... E04F 21/1855 33/646
472,846 A * 4/1892 Avery ..... E04D 15/025 33/649
1,031,854 A * 7/1912 Keyes ..... E04F 21/1855 7/122
1,750,854 A 3/1930 Nelson
(Continued)

OTHER PUBLICATIONS

PACTOOL International Gecko Gauge USer Guide—downloaded Sep. 26, 2019; URL unavailable.

*Primary Examiner* — Kyle J. Walraed-Sullivan
(74) *Attorney, Agent, or Firm* — David S. Alavi

(57) ABSTRACT

A siding installation gauge includes a tool body, an upper support member, a clamp, and an actuating mechanism. A clamping portion of the clamp is inserted behind an installed lower siding board and the tool actuated to secure the lower board between the clamp and tool body. An upper siding board rests on registration surfaces on the upper support member while it is fastened for installation. The clamp includes coupling and clamping portions; movement of the actuating mechanism to an actuated arrangement retracts the coupling portion into or through the tool body and thereby forces movement of the clamp toward the tool body to secure the lower siding board. In the actuated arrangement, the actuating mechanism retains the clamp in a clamped arrangement; in the non-actuated arrangement, the actuating mechanism permits movement of the clamp into a non-clamped arrangement.

28 Claims, 4 Drawing Sheets

(56) References Cited

U.S. PATENT DOCUMENTS

| | | | | | |
|---|---|---|---|---|---|
| 3,357,464 | A | | 12/1967 | Vroman | |
| 3,490,152 | A | | 1/1970 | Printz | |
| 4,155,175 | A | | 5/1979 | Stiles | |
| 4,425,714 | A | | 1/1984 | Kelly | |
| 4,473,100 | A | * | 9/1984 | Wheeler | E04F 21/1855 33/647 |
| 4,484,392 | A | | 11/1984 | DeFino et al. | |
| 4,658,490 | A | | 4/1987 | Czelusniak et al. | |
| 4,698,942 | A | | 10/1987 | Swartz | |
| 4,819,404 | A | | 4/1989 | Lafayette | |
| 4,862,669 | A | | 9/1989 | Jacobsen | |
| 5,290,019 | A | | 3/1994 | Beyers | |
| 5,291,719 | A | | 3/1994 | Buster | |
| 5,319,909 | A | | 6/1994 | Singleterry | |
| 5,370,377 | A | * | 12/1994 | Van Der Meer | E04F 21/1855 33/647 |
| 5,456,053 | A | | 10/1995 | Fischer | |
| 5,465,499 | A | | 11/1995 | Laplante | |
| 5,623,767 | A | | 4/1997 | Colavlto | |
| 6,223,492 | B1 | | 5/2001 | Barnhart et al. | |
| 6,367,160 | B1 | | 4/2002 | Rempe | |
| 6,370,836 | B1 | | 4/2002 | Gunn | |
| 6,434,909 | B1 | | 8/2002 | Carpenter | |
| 6,438,924 | B1 | | 8/2002 | Clover | |
| 6,494,016 | B1 | | 12/2002 | Bankson | |
| 6,612,089 | B1 | | 9/2003 | Mann | |
| 6,755,002 | B2 | | 6/2004 | Pendrous et al. | |
| 6,814,334 | B1 | | 11/2004 | Whitehead | |
| 6,928,743 | B1 | | 8/2005 | Marshall | |
| 7,134,253 | B2 | | 11/2006 | Edwards et al. | |
| 7,152,380 | B2 | | 12/2006 | Pendrous et al. | |
| 7,213,346 | B1 | | 5/2007 | Gregory | |
| 8,359,762 | B1 | * | 1/2013 | Blasi | E04F 21/1855 33/646 |
| 9,885,198 | B1 | * | 2/2018 | Risley | E04H 17/26 |
| 10,590,663 | B1 | * | 3/2020 | Meeks | E04F 21/1855 |
| 2002/0023366 | A1 | | 2/2002 | Bueno | |
| 2004/0221467 | A1 | | 11/2004 | Chillington | |
| 2004/0237461 | A1 | * | 12/2004 | Edwards | E04F 21/1855 52/749.1 |

* cited by examiner

SIDING INSTALLATION GAUGE

BENEFIT CLAIMS TO RELATED APPLICATIONS

This application claims benefit of U.S. provisional App. No. 62/766,070 entitled "Siding installation gauge SOLO-PRO by SOLOSIDER LLC" filed Oct. 1, 2018 in the names of Catherine A. Gregory and Leonard Cramer, said provisional application being hereby incorporated by reference as if fully set forth herein.

FIELD OF THE INVENTION

The field of the present invention relates to tools for installing siding. In particular, examples of an inventive siding installation gauge and methods for its use are disclosed herein.

BACKGROUND

Some examples of tools for aligning or installing siding boards or flooring are disclosed in:

- U.S. Pat. No. 1,031,854 entitled "Siding and shingling gage" issued Jul. 09, 1912 to Keyes;
- U.S. Pat. No. 1,750,854 entitled "Shingle gauge" issued Mar. 18, 1930 to Nelson;
- U.S. Pat. No. 3,357,464 entitled "Carpenter's aligning tool" issued Dec. 12, 1967 to Vroman;
- U.S. Pat. No. 3,490,152 entitled "Building siding applicator tool" issued Jan. 20, 1970 to Printz;
- U.S. Pat. No. 4,155,175 entitled "Siding hanging tool" issued May 22, 1979 to Stiles;
- U.S. Pat. No. 4,425,714 entitled "Siding board installation tool" issued Jan. 17, 1984 to Kelly;
- U.S. Pat. No. 4,484,392 entitled "Method and means of installing siding" issued Nov. 27, 1984 to DeFino et al;
- U.S. Pat. No. 4,658,490 entitled "Siding installation tool" issued Apr. 21, 1987 to Czelusniak et al;
- U.S. Pat. No. 4,698,942 entitled "Clip for holding and spacing siding panels" issued Oct. 13, 1987 to Swartz;
- U.S. Pat. No. 4,819,404 entitled "Apparatus and method for mounting stone siding" issued Apr. 11, 1989 to Lafayette;
- U.S. Pat. No. 4,862,669 entitled "Alignment and support tool for building siding" issued Sep. 05, 1989 to Jacobsen;
- U.S. Pat. No. 5,290,019 entitled "Adjustable siding installation hanger assembly" issued Mar. 01, 1994 to Beyers;
- U.S. Pat. No. 5,291,719 entitled "Support/guide device for use in the installation of horizontally-disposed siding" issued Mar. 08, 1994 to Buster;
- U.S. Pat. No. 5,319,909 entitled "Tool for lap siding installation" issued Jun. 14, 1994 to Singleterry;
- U.S. Pat. No. 5,456,053 entitled "Flooring installation apparatus" issued Oct. 10, 1995 to Fischer;
- U.S. Pat. No. 5,465,499 entitled "Tool for installing siding" issued Nov. 14, 1995 to Laplante;
- U.S. Pat. No. 5,623,767 entitled "Siding installation alignment tool" issued Apr. 29, 1997 to Colavito;
- U.S. Pat. No. 6,223,492 entitled "Alignment and spacer apparatus and siding panel installation system" issued May 01, 2001 to Barnhart et al;
- U.S. Pat. Pub. No. 2002/0023366 entitled "Siding installation tool, kit and method" published Feb. 28, 2002 in the name of Bueno;

- U.S. Pat. No. 6,367,160 entitled "Siding gauge tool" issued Apr. 09, 2002 to Rempe;
- U.S. Pat. No. 6,370,836 entitled "Floor board compression apparatus" issued Apr. 16, 2002 to Gunn;
- U.S. Pat. No. 6,434,909 entitled "Roofing tool system and method" issued Aug. 20, 2002 to Carpenter;
- U.S. Pat. No. 6,438,924 entitled "Slot forming tool for wall construction" issued Aug. 27, 2002 to Clover;
- U.S. Pat. No. 6,494,016 entitled "Installation device for installing siding and method therefor" issued Dec. 17, 2002 to Bankson;
- U.S. Pat. No. 6,612,089 entitled "Power inside corner planer and method of use" issued Sep. 02, 2003 to Mann;
- U.S. Pat. No. 6,755,002 entitled "Apparatus and method for repairing popped wallboard nails" issued Jun. 29, 2004 to Pendrous et al;
- U.S. Pat. Pub. No. 2004/0221467 entitled "Tool kit for installing roofing or siding materials" published Nov. 11, 2004 in the name of Chillington;
- U.S. Pat. No. 7,152,380 entitled "Apparatus and method for repairing popped wallboard nails" issued Dec. 26, 2006 to Pendrous et al;
- U.S. Pat. No. 6,814,334 entitled "Method and apparatus for limiting movement of insulation during building construction" issued Nov. 09, 2004 to Whitehead;
- U.S. Pat. No. 6,928,743 entitled "Siding installation tool" issued Aug. 16, 2005 to Marshall;
- U.S. Pat. No. 7,134,253 entitled "Siding installation apparatuses and methods for installing siding pieces on walls" issued Nov. 14, 2006 to Edwards et al; and
- U.S. Pat. No. 7,213,346 entitled "Installation tool for horizontal siding boards" issued May 08, 2007 to Gregory.

Each one of the listed patents and publications is incorporated by reference as if fully set forth herein. The apparatus and methods disclosed herein may provide functionality not provided by those previous tools, or may remedy deficiencies exhibited by those previous tools.

SUMMARY

An inventive tool (used as a siding installation gauge) comprises a tool body, an upper support member, a clamp, and an actuating mechanism. The tool body has a rear board engagement surface. The upper support member is attached to and extends upward from the tool body and has one or more upper registration surfaces. The clamp is engaged with and movable, relative to the tool body, between a clamped arrangement and an unclamped arrangement. The clamp includes a coupling portion and a clamping portion. The coupling portion is engaged with and extends rearward from the tool body; the clamping portion is substantially rigidly attached to a rearward end of the coupling portion and extends upward spaced apart from the rear board engagement surface of the tool body. The actuating mechanism is coupled to the tool body and the clamp and is movable between an actuated arrangement and a non-actuated arrangement. With the clamp in the clamped arrangement, the tool is characterized by a clamp spacing between the rear board engagement surface and the clamping portion of the clamp. The upper registration surfaces engage and support a lower edge of an upper siding board that is positioned on them with a lower portion of a rear surface the upper siding board facing an upper portion of a front surface of a lower siding board received between the clamping portion of the clamp and the rear board engagement surface. Movement of the actuating mechanism from the non-actuated arrangement to the actuated arrangement at least partly retracts the coupling portion into or through the tool body and thereby forces movement of the clamp toward the rear board engagement surface into the clamped arrangement. In the actuated arrangement, the actuating mechanism retains the clamp in the clamped arrangement. In the non-actuated arrangement, the actuating mechanism permits movement of the clamp into the non-clamped arrangement.

An inventive tool can be employed to perform an inventive siding installation method. With the rear board engagement surface facing a front surface of a lower siding board already installed on the wall, and with the actuating mechanism in the non-actuated arrangement, the clamping portion of the clamp is inserted behind a lower edge of the lower siding board with the lower siding board between the clamping portion of the clamp and the rear board engagement surface. The actuating mechanism is moved from the non-actuated arrangement to the actuated arrangement, thereby moving the clamp into the clamped arrangement to clamp the tool onto the lower siding board. An upper siding board is positioned with its lower edge on the upper registration surfaces and with a lower portion of its rear surface against an upper portion of a front surface of the lower siding board. With the upper siding board supported by the upper registration surfaces, the upper siding board is fastened to the wall. The actuating mechanism is moved from the actuated position to the non-actuated position to release the tool from the lower siding board, and the tool is removed from the lower siding board. Two identical tools can be employed at or near opposite ends of the upper siding board to support it while it is fastened to the wall. The method can be repeated with additional upper siding boards, with each preceding installed upper siding board acting as the lower siding board for the next one.

Various example embodiments of an inventive tool can further include one or more of: adjustability of the clamp spacing, one or more lower registration surfaces for engaging the lower edge of the lower siding board, an adjustable upper support member that enables setting of a reveal spacing between successively installed siding boards, an upper board retainer movable between insertion and retention positions, a clamp lever with adjustable clamp lever spacing, or an actuating lever and adjustable spring-biased bearing surface for adjusting the clamping spacing or clamping force.

Objects and advantages pertaining to siding installation tools or gauges may become apparent upon referring to the example embodiments illustrated in the drawings and disclosed in the following written description or appended claims.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

Figure 1:
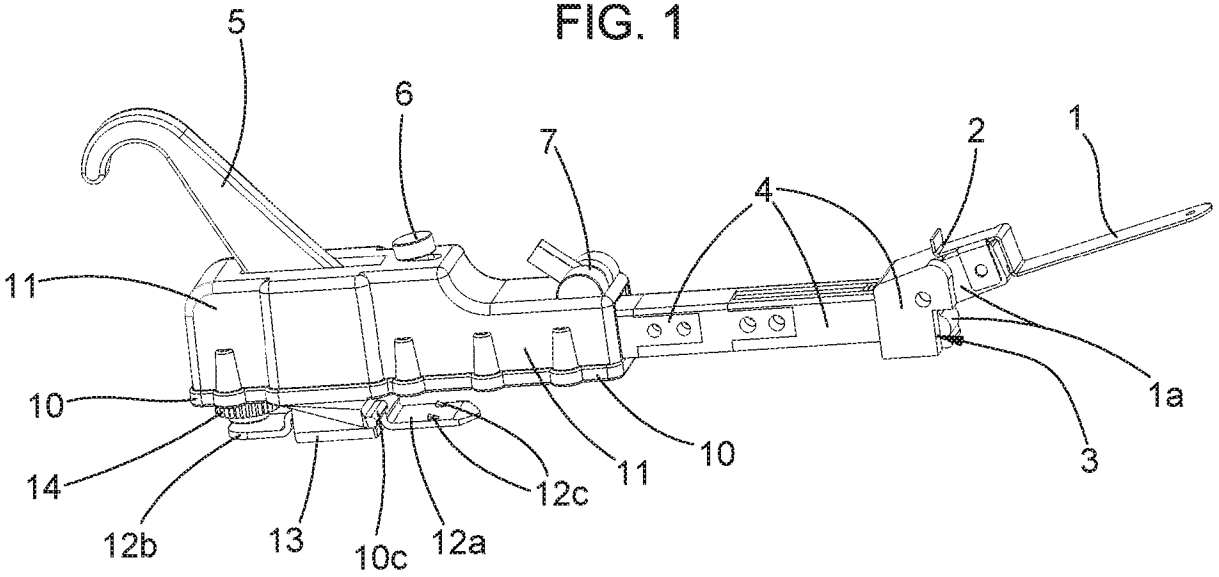
FIGS. 1 and 2 are oblique views of an inventive siding installation gauge in an unclamped arrangement.

The embodiments depicted are shown only schematically; all features may not be shown in full detail or in proper proportion; for clarity certain features or structures may be exaggerated or diminished relative to others or omitted entirely; the drawings should not be regarded as being to scale unless explicitly indicated as being to scale. The embodiments shown are only examples and should not be construed as limiting the scope of the present disclosure or appended claims.

DETAILED DESCRIPTION OF EMBODIMENTS

Several tools exist that are used as siding installation gauges. When installing horizontal siding boards on a wall, it is desirable to maintain substantially parallel, substantially uniform spacing between successive boards. A siding installation gauge can be set to provide a desired spacing (i.e., the "reveal") between the lower edge of an already-installed siding board (hereinafter referred to as the lower siding board 98) and the next siding board to be installed (referred to hereinafter as the upper siding board 99). Typically two tools are used together, one at or near each end of the siding board to be installed. An example of such a tool is, e.g., in U.S. Pat. No. 7,134,253 (Edwards et al). The Edwards tool clamps onto the lower edge of the lower siding board and supports the upper siding board while it is fastened. A notable drawback of previous tools is that while the clamp must be tightened sufficiently to support the weight of the siding board, excessive tightening of the clamp causes to tool to shift away from the lower siding board and allow the upper siding board to fall between the tool and the lower siding board. Indeed, the instruction manual for the Edwards device explicitly warns of this problem and is hereby incorporated by reference. It would be desirable to provide an inventive tool to be used as a siding installation gauge that avoids that drawback and that can also exhibit other desirable features.

For purposes of the present disclosure or appended claims, front/forward, rear/rearward, upper/upward, lower/downward, and lateral are defined relative to the (presumably) vertical wall or other installation surface on which the siding boards are being installed with their long dimensions oriented (presumably) horizontally. The rear surfaces of the siding boards and the inventive tool face the wall, while front surfaces face away from the wall. The rearward direction is toward the wall, while the forward direction is away from the wall, with both forward and rearward directions being roughly perpendicular to the wall. Upward and downward directions are roughly parallel to the wall with the installation beginning at a lower part of the wall and proceeding in an upward direction, with a lower portion of the rear surface of each siding board positioned against an upper portion of the front surface of the siding board immediately below it. Lateral directions are roughly parallel to the wall and roughly perpendicular to forward, rearward, upward, and downward directions. Note however that those direction are not to be interpreted as absolute directions, but are more accurately regarded as being defined relative to the elongated siding (or other) boards being installed on a wall (or other installation surface). Forward and rearward are therefore roughly perpendicular to the installation surface, lateral is roughly parallel to the long dimensions of the boards, and upward and downward are roughly perpendicular to the long dimensions of the boards. The term "surface"

(e.g., an installation surface, a registration surface, or an engagement surface) can comprise a single contiguous surface, multiple discrete areas, or multiple discrete contact points. For example, an installation surface might comprise contiguous sheets of plywood sheathing or a series of wall studs, an engagement surface might include various relief cutouts, or a registration surface might include a curved bearing surface providing only a line or point of contact. Any suitable arrangement shall be encompassed by the term surface. The term "attached" can include examples wherein two members are attached by being integrally formed together or by being discrete members that are assembled together.

Figure 2:
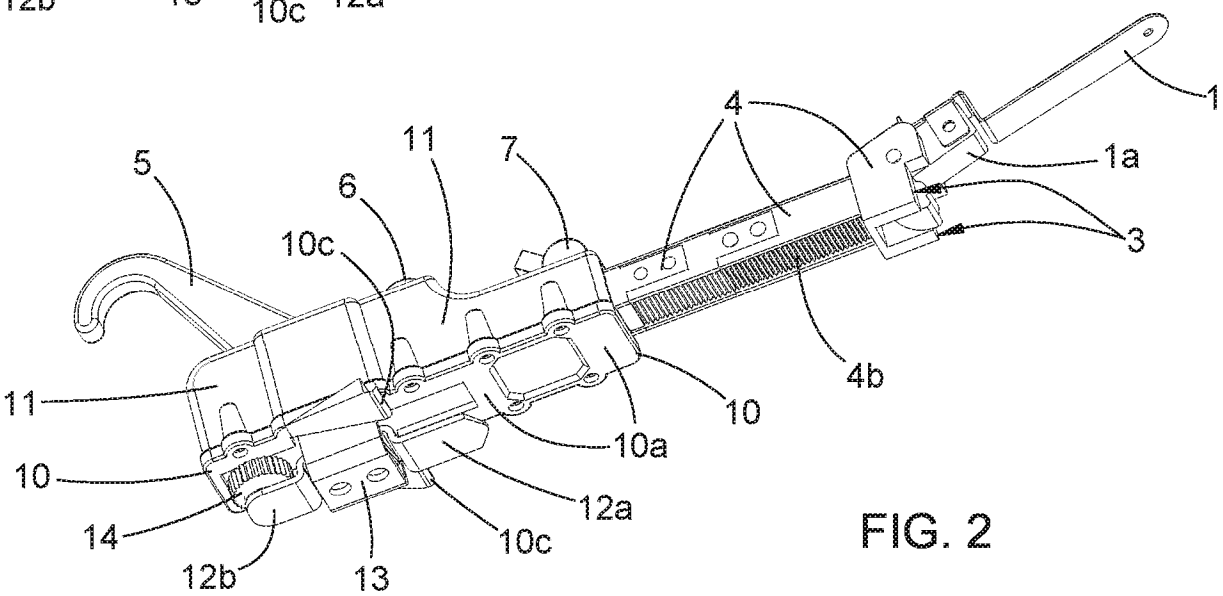
Figure 3:
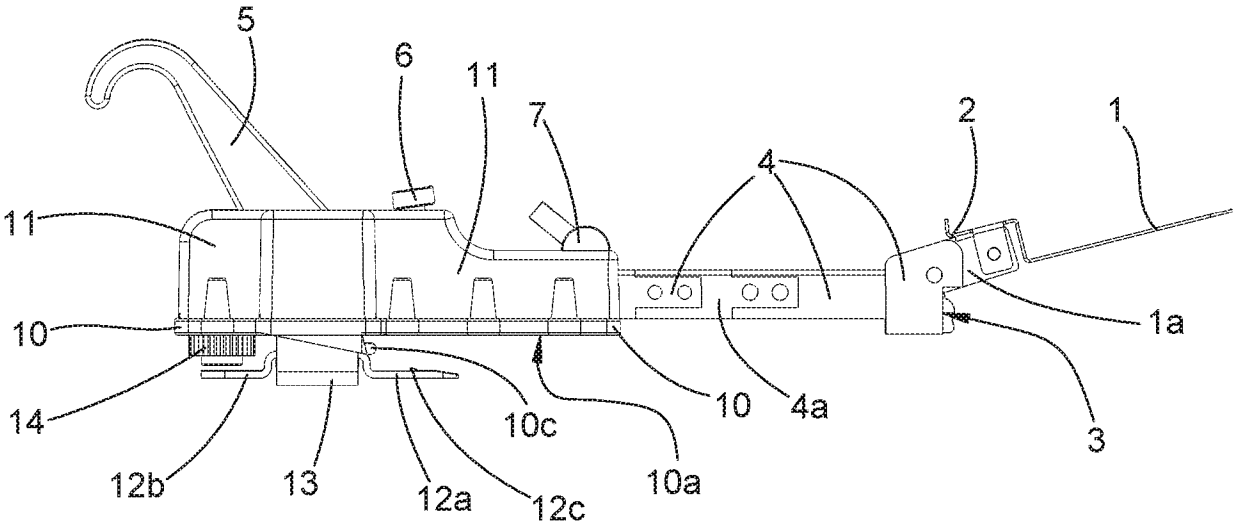
FIGS. 3 and 4 are side views with and without the tool body housing, respectively, of an inventive siding installation gauge in an unclamped arrangement.
Figure 4:
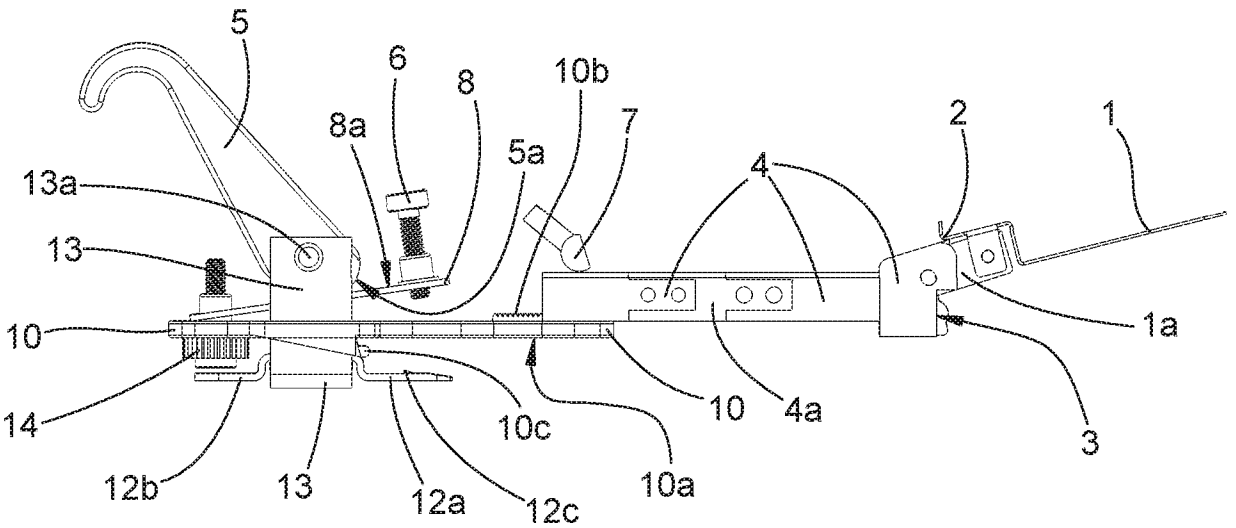
Figure 5:
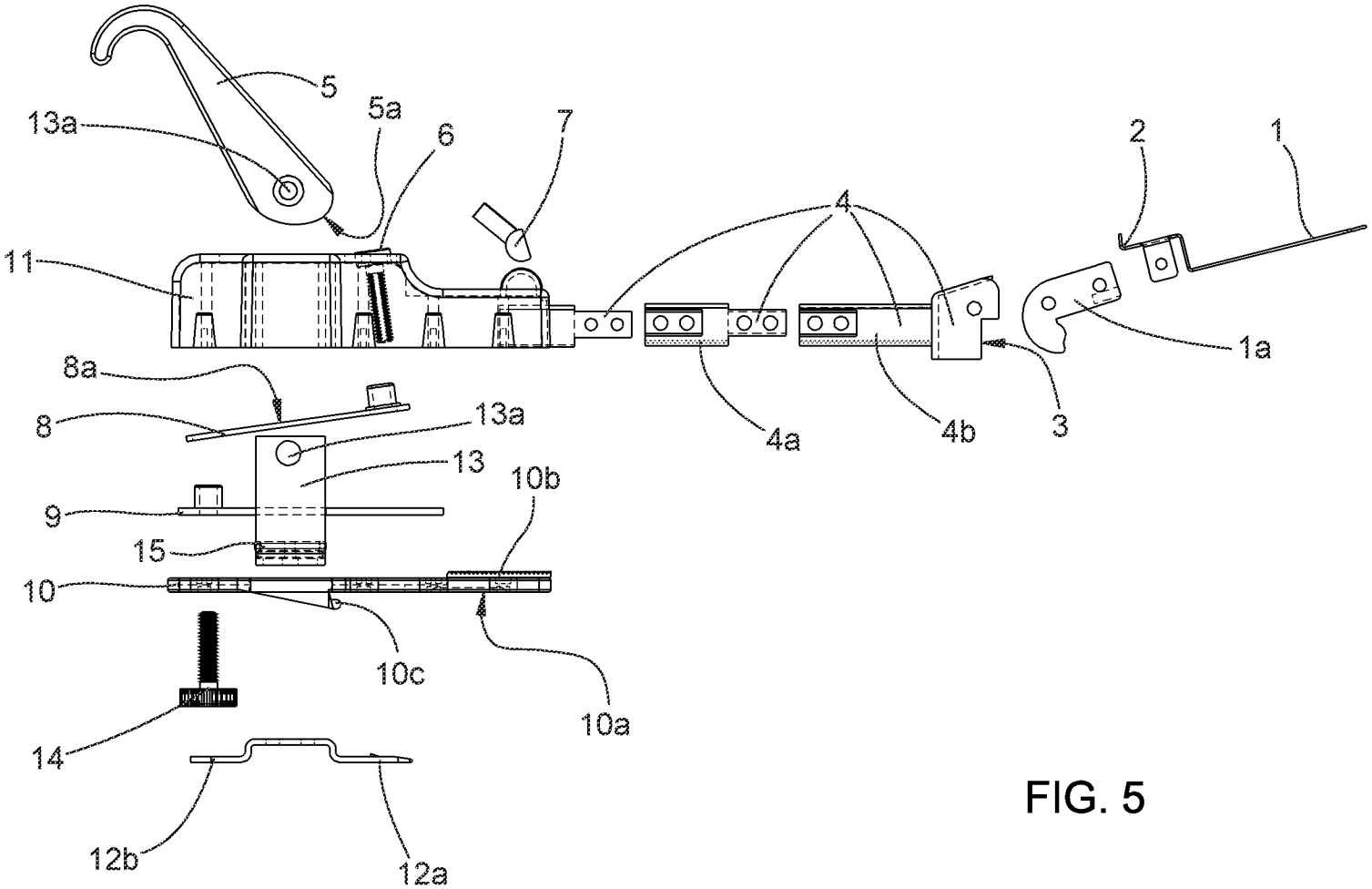
FIG. 5 is an exploded view of an inventive siding installation gauge.
Figure 6A:
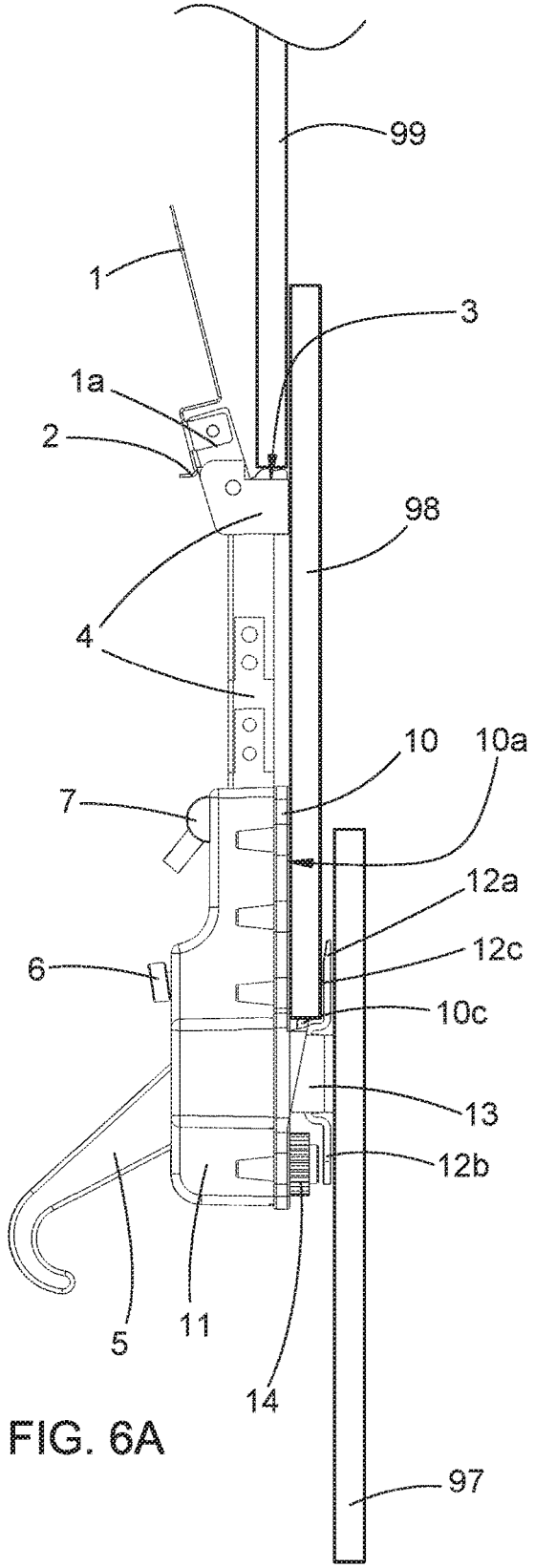
FIGS. 6A and 6B are side views of an inventive siding installation gauge engaged with siding boards in unclamped and clamped arrangements, respectively.
Figure 6B:
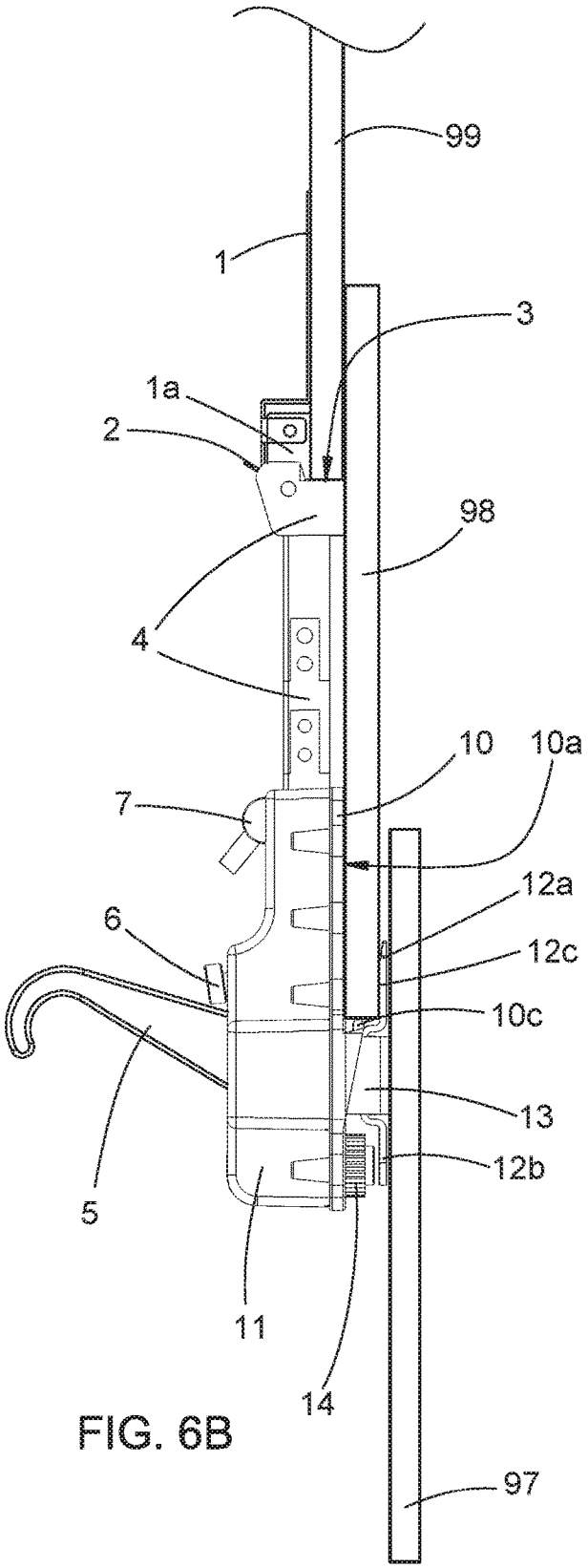

An inventive tool to be used as a siding installation gauge includes a tool body, an upper support member, a clamp, and an actuating mechanism. In the example shown in FIGS. 1 through 6B the tool body is a two-piece assembly including a base 10 and housing 11, which will hereinafter be referred to collectively as tool body 10/11; other suitable arrangements can be employed. The tool body 10/11 includes a rear board engagement surface 10*a*. In the example shown the rear board engagement surface 10*a* includes a substantially planar area circumscribing a recessed relief cutout area; other suitable arrangements of the rear board engagement surface 10*a* can be employed. The upper support member 4 is attached to and extends upward from the tool body 10/11. In the example shown the upper support member 4 includes a support spacer 4*a* used for selecting a range of reveal spacings (discussed further below). Such a support spacer can be omitted in some examples, multiple support spacers can be employed in some examples, the upper support member 4 can be a unitary member in some examples with nowhere to insert a spacer, or the upper support member 4 or a portion thereof can be integrally formed with the tool body 10/11 or a portion thereof in some examples. The upper support member 4 includes one or more upper registration surfaces 3 that are structurally arranged so as to engage and support a lower edge of an upper siding board 99.

The clamp is engaged with and movable, relative to the tool body 10/11, between a clamped arrangement and an unclamped arrangement. The clamp includes a coupling portion 13 and a clamping portion 12*a*. The coupling portion 13 is engaged with and extends rearward from the tool body 10/11, and the clamping portion 12*a* is substantially rigidly attached to a rearward end of the coupling portion 13 and extends upward. The clamping portion 12*a* is spaced apart from the rear board engagement surface 10*a* of the tool body 10/11, providing a space for receiving and clamping the lower edge of a lower siding board 98. With the clamp in the clamped arrangement, the tool is characterized by a clamp spacing between the rear board engagement surface 10*a* and the clamping portion 12*a* of the clamp. The actuating mechanism is coupled to the tool body 10/11 and the clamp and is movable between an actuated arrangement and a non-actuated arrangement. Movement of the actuating mechanism from the non-actuated arrangement to the actuated arrangement at least partly retracts the coupling portion 12*a* into or through the tool body 10/11 and thereby forces movement of the clamp toward the rear board engagement surface 10*a* into the clamped arrangement. In the actuated arrangement, the actuating mechanism retains the clamp in the clamped arrangement, while in the non-actuated arrangement, the actuating mechanism permits movement of the clamp into the non-clamped arrangement.

With a lower siding board 98 received between the clamping portion 12*a* of the clamp and the rear board engagement surface 10*a*, movement of the clamp into the clamped arrangement results in the clamping portion 12*a* being urged against a rear surface of the lower siding board 98 which in turn urges a front surface of the lower siding board 98 against the rear board engagement surface 10*a*, thereby securing the tool to the lower siding board 98. In some examples the tool can further include one or more protruding teeth 12*c* on a front surface of the clamping portion 12*a* of the clamp; the example embodiment shown includes two such teeth 12*c*. With the clamping portion 12*a* urged against a rear surface of the lower siding board 98, the teeth 12*c* indent or penetrate the back surface of the lower siding board 98 to further secure the tool attached to the lower siding board 98. The lower siding board 98 typically is already installed on the wall or other mounting surface. To facilitate insertion of the clamping portion 12*a* behind the installed lower siding board 98 (e.g., between the lower siding board 98 and a next-lower siding board 97), in some examples the upper edge of the clamping portion 12*a* of the clamp is beveled (as in the example shown). In examples that include protruding teeth, those can be wedged to facilitate insertion of the clamping portion 12*a* and the teeth 12*c* behind the installed lower siding board 98 (as in the example shown).

To accommodate siding boards of different thicknesses, in some examples the one or more of the tool body 10/11, the clamp, or the actuating mechanism can be arranged so as to enable adjustment of the clamp spacing. In some such examples (including the example shown), the tool further includes one or more clamp spacers 15 that are insertable between the coupling portion 13 and the clamping portion 12*a* of the clamp. The clamp spacing exhibited by the tool with one clamp spacer 15 inserted differs from the clamp spacing exhibited by the tool with the clamp spacer absent (smaller clamp spacing with the spacer 15 present in the arrangement shown; in other arrangements the clamp spacing with the spacer 15 present can be larger). In some examples multiple spacers 15 can be employed, and clamp spacing exhibited by the tool with different numbers of spacers inserted differ from one another. Other arrangements for enabling adjustment of the clamp spacing can be employed; one or more such examples are discussed further below.

With the inventive tool clamped onto the lower edge of an installed lower siding board 98, an upper siding board 99 can be positioned with its lower edge on the one or more upper registration surfaces 3. Typically two inventive tools are employed as a pair at or near the ends of the upper siding board 99 to be supported. Thus positioned, a lower portion of the rear surface of the upper siding board 99 faces an upper portion of a front surface of the installed lower siding board 98 that is received between the clamping portion 12*a* of the clamp and the rear board engagement surface 10*a*. The relative position of the upper registration surfaces 3 above the lower edge of the installed lower siding board 98 sets the reveal spacing for the installed siding. In some examples the upper support member 4 is attached to the tool body 10/11 so as to maintain only a single substantially fixed position of the upper registration surfaces 3 relative to the tool body 10/11 and the clamp. In other words, the reveal spacing produced by such a tool is fixed and cannot be adjusted. On other examples, the upper support member 4 is attached to the tool body 10/11 so as to permit selection or adjustment of a position, among multiple different positions, of the upper registration surfaces 3 relative to the tool body 10/11 and the clamp. In other words, the reveal spacing produced by such a tool can be adjusted. Any suitable arrangement can be employed for enabling such adjustment, including but not limited to one or both of the tool body 10/11 or the upper support member 4 including mating holes with fasteners or pins, a longitudinal rail or slot, mating teeth, mating tabs and slots, or one or more support spacers 4*a* insertable between the tool body 10/11 and the upper support member 4 or within the upper support member 4 (discussed above), a rack-and-pinion mechanism, a lead screw mechanism, or other suitable mechanism or arrangement. In the example shown, the upper support member 4 includes an insertable/removable support spacer 4*a* that permits coarse adjustment of the reveal spacing, and also includes mating teeth 4*b*/10*b* on the upper support member 4 and the tool body 10, respectively. Engagement of the mating teeth 4*b*/10*b* retains the upper support members 3 at a selected substantially fixed position relative to the tool body 10/11, and one or both of the tool body 10/11 or the upper support member 4 includes a locking mechanism structurally arranged for engaging the mating teeth 4*b*/10*b* at the selected position. In the example shown a locking cam 7 is employed. Markings, notched, scores, a printed scale, or other mechanical or visual indicator can be included on the upper support member 4 to aid in repeatable positioning of the upper registration surfaces 3 to achieve a desired reveal spacing.

In some examples the inventive tool can further include one or more lower registration surfaces 10*c* substantially rigidly attached to the tool body 10/11. The clamping portion 12*a* of the clamp extends upward beyond the one or more lower registration surfaces 10*c*, which are arranged so as to engage the lower edge of the lower siding board 98 received between the clamping portion 12*a* of the clamp and the rear board engagement surface 10*a*. The distance between the upper registration surfaces 3 and the lower registration surfaces 10*c* corresponds to the reveal spacing, i.e., the distance between the lower edge of the lower siding board 98 engaged with the lower registration surfaces 10*c* and the lower edge of the upper siding board 99 engaged with and supported by the upper registration surfaces 3. Repeatability of the reveal spacing can be enhanced by inclusion of the lower registration surfaces 10*c*.

While the upper siding board 99 is supported by the inventive tool (or more typically a pair of tools), it is fastened to the wall or other installation surface in any suitable way. In some examples, the inventive tool can further include an upper board retainer 1 attached to the upper support member 4. The upper board retainer 1 extends upward from the upper registration surfaces 3, and engages a front surface of the upper siding board 99 positioned on and supported by the upper registration surfaces 3. In some examples the upper board retainer 1 might serve only to prevent (or decrease the likelihood of) the upper siding board 99 inadvertently tumbling off of the upper registration surfaces 3 before the upper siding board 99 is fastened. In some examples the upper board retainer 1 can be substantially rigidly attached to the upper support member 4 in only a single position. In some examples the upper board retainer 1 can be arranged to urge the upper siding board against the lower siding board or the installation surface; in some such examples the upper board retainer 1 can include a flexible or resilient portion (e.g., thin spring steel or stiff but elastic polymer) that can be bent forward (i.e., away from the wall) to accommodate the upper siding board 99 and then released to press against the upper siding board 99.

In some examples the upper board retainer 1 can be engaged with and moveable, relative to the upper support member 4, between an insertion position and a retention position. In the retention position the upper board retainer 1 engages the front surface of the upper siding board 99 and urges it rearward against the lower siding board 98. In the insertion position, the upper board retainer 1 is tilted forward (i.e., away from the wall) relative to the retention position. The forward tilt of the upper board retainer 1 in the insertion position facilitates placement of the upper siding board on the upper registration surfaces 3. In some such examples, the upper board retainer 1 includes a retainer lever 1*a*. With the upper board retainer 1 in the insertion position, the retainer lever 1*a* protrudes upward beyond the upper registration surfaces 3; placement of the upper siding board 99 on the upper registration surfaces 3 pushes the retainer lever 1*a* downward and moves the upper board retainer 1 from the insertion position into the retention position. In some of those examples, the upper board retainer also includes a retainer lock 2 that engages upon movement of the upper board retainer 1 into the retention position. Engagement of the retainer lock 2 substantially prevents movement of the upper board retainer 1 into the insertion position, and presence of the upper siding board 99 positioned on the upper registration surfaces 3 substantially prevents disengagement of the retainer lock. Absence of the upper siding board permits disengagement of the retainer lock 2 and movement of the upper board retainer 1 into the insertion position.

In some examples the inventive tool further includes a clamp lever 12*b* and a clamp stop 14. The clamp lever 12*b* is substantially rigidly attached to, and extends downward from, the rearward end of the coupling portion 13 of the clamp. The clamp stop 14 is attached to the clamp lever 12*a* or the tool body 10/11 (as in the example shown) and is positioned between the clamp lever 12*b* and the tool body 10/11. The clamp lever 12*b* and the clamp stop 14 are arranged so that movement of the clamp into the clamped arrangement results in engagement of the clamp lever 12*b*, clamp stop 14, and tool body 10/11 with the clamp lever 12*b* separated from the tool body 10/11 by a clamp lever spacing. The presence of the clamp lever 12*b* and the clamp stop 14 provides additional leverage for urging the clamping portion 12*a* against the lower siding board 98, with the engaged clamp lever 12*b* and clamp stop 14 acting as the fulcrum of a Class 3 lever (i.e., effort between fulcrum and load) as the actuating mechanism moves into the actuated arrangement and the coupling member 13 retracts into or through the tool body 10/11. In some such examples the clamp stop 14 is not adjustable and therefore provides only a single, substantially fixed clamp lever spacing. In other such examples, the clamp stop 14 is movable so as to permit selection or adjustment of the clamp lever spacing among multiple different clamp lever spacings. In the example shown, the clamp stop 14 is threaded into an interior baseplate 9 within the tool body 10/11. The adjustable clamp lever spacing provides fine adjustment for accommodating bottom siding boards 98 of slightly differing thickness, or for adjusting the force exerted by the clamp on the lower siding board 98.

A certain amount of rocking forward and back (i.e., pitch, or rotation about an axis roughly parallel to the long dimension of the siding boards) can be desirable for implementing the arrangement of the clamp lever 12*b* and the clamp stop 14 as described above. Excessive lateral rocking (i.e., roll, rotation about an axis roughly perpendicular to the wall) typically would be considered undesirable. Accordingly, in some examples the tool body 10/11 and the coupling portion 13 of the clamp are structurally arranged so as to substantially prevent lateral movement or rotation of the clamp relative to the tool body 10/11. In the example shown, that prevention is achieved by simply limiting space through which the coupling member 13 can move. Lateral walls of an opening in the tool body through which the coupling portion protrudes can be position against the sides of the coupling member 13 to limit its lateral motion.

In some examples the actuating mechanism includes an actuating lever 5 that is attached to the coupling member 13 of the clamp and rotatable about an actuating lever axis 13*a*. The actuating lever 5 extends forward from the tool body 10/11 (i.e., away from the wall), includes a cam surface 5*a* arranged eccentrically with respect to the actuating lever axis 13*a*, and is engaged at the cam surface 5 with a bearing surface 8*a* of the tool body 10/11. Rotation of the actuating lever 5 from the non-actuated arrangement to the actuated arrangement engages the cam surface 5 with the bearing surface 8*a* so as to push the actuating lever 5 rearward, at least partly retract the coupling portion 13 of the clamp into or through the tool body 10/11, and force movement of the clamp toward the rear board engagement surface 10*a* into the clamped arrangement. In some examples the bearing surface 8*a* can be in a single fixed position. In other examples (include the example shown), the bearing surface 8*a* of the tool body 10/11 is moveable relative to the tool body 10/11 among multiple bearing surface positions; each bearing surface position corresponds to a different one of multiple different clamp spacings, providing yet another way to adjust the clamp spacing to accommodate lower siding boards of different thicknesses or to adjust the force exerted on the lower siding board by the clamp in the clamped arrangement. In the example shown, the bearing surface 8*a* of the tool comprises a surface of a flattened spring member 8 within the tool body 10/11 with an adjustment screw 6 threaded through at a first end. With the actuating lever 5 in the actuated arrangement, a second end of the spring member 8 and a threaded end of the screw 6 are pressed against an inner surface of the tool body 10/11 by force exerted by the cam surface 5*a* engaged with the bearing surface 8*a*. By turning the adjustment screw 6 and changing the length of its threaded end extending through the spring member 8, one or both of the clamp spacing or the force exerted by the clamp can be adjusted. In the example shown, the actuating lever is moved to about halfway between its actuated and non-actuated positions with a siding board inserted between the clamping portion 12*a* and the rear board engagement surface 10*a*. The adjustment screw 6 is then hand-tightened to set initially the clamp spacing. The adjustment screw 6 can be adjusted further in response to observed variations in siding board thickness, or an observation that the clamping force is too large or too small. The adjustment screw can be adjusted in tandem with adjustment of the clamp stop 14 (if present) to "fine tune" the clamp spacing or clamping force.

Any suitable one or more sufficiently strong, sufficiently rigid, sufficiently durable materials can be employed for constructing the inventive tool. In some examples each part or component can be made of one or more materials that differ from those of at least one other part or component; in other examples the same one or more materials can be employed for all ports or components. Examples of suitable materials can include metals or metal alloys, plastics, resins, or other polymers.

In addition to the preceding, the following example embodiments fall within the scope of the present disclosure or appended claims:

Example 1. A tool comprising: (a) a tool body having a rear board engagement surface; (b) an upper support member attached to and extending upward from the tool body and having one or more upper registration surfaces; (c) a clamp engaged with and movable, relative to the tool body, between a clamped arrangement and an unclamped arrangement, the clamp including (i) a coupling portion engaged with and extending rearward from the tool body and (ii) a clamping portion substantially rigidly attached to a rearward end of the coupling portion and extending upward therefrom spaced apart from the rear board engagement surface of the tool body; and (d) an actuating mechanism (i) coupled to the tool body and the clamp and (ii) movable between an actuated arrangement and a non-actuated arrangement, wherein: (e) with the clamp in the clamped arrangement, the tool is characterized by a clamp spacing between the rear board engagement surface and the clamping portion of the clamp; (f) the one or more upper registration surfaces are structurally arranged so as to engage and support a lower edge of an upper siding board that is positioned on the one or more upper registration surfaces with a lower portion of a rear surface the upper siding board facing an upper portion of a front surface of a lower siding board received between the clamping portion of the clamp and the rear board engagement surface; and (g) the tool body, the clamp, and the actuating mechanism are structurally arranged so that (i) movement of the actuating mechanism from the non-actuated arrangement to the actuated arrangement at least partly retracts the coupling portion into or through the tool body and thereby forces movement of the clamp toward the rear board engagement surface into the clamped arrangement, (ii) in the actuated arrangement, the actuating mechanism retains the clamp in the clamped arrangement, and (iii) in the non-actuated arrangement, the actuating mechanism permits movement of the clamp into the non-clamped arrangement.

Example 2. The tool of Example 1 wherein the tool body and the clamp are structurally arranged so that, with a lower siding board received between the clamping portion of the clamp and the rear board engagement surface, movement of the clamp into the clamped arrangement results in the clamping portion being urged against a rear surface of the lower siding board which in turn urges a front surface of the lower siding board against the rear board engagement surface, thereby securing the tool to the lower siding board.

Example 3. The tool of Example 2 further comprising one or more protruding teeth on a front surface of the clamping portion of the clamp, the one or more teeth being structurally arranged so that, with the clamping portion urged against a rear surface of the lower siding board, the one or more teeth indent or penetrate the back surface of the lower siding board.

Example 4. The tool of Example 3 wherein each one of the one or more protruding teeth is wedged so as to facilitate insertion of the one or more protruding teeth behind the lower siding board along with the clamping portion.

Example 5. The tool of any one of Examples 1 through 4 wherein an upper edge of the clamping portion of the clamp is beveled so as to facilitate insertion of the clamping portion behind the lower siding board.

Example 6. The tool of any one of Examples 1 through 5 wherein one or more of the tool body, the clamp, or the actuating mechanism are structurally arranged so as to enable adjustment of the clamp spacing.

Example 7. The tool of Example 6 further comprising one or more clamp spacers that are insertable between the coupling and clamping portions of the clamp and structurally arranged so that the clamp spacing exhibited by the tool with one clamp spacer inserted differs from the clamp spacing exhibited by the tool with the clamp spacer absent, and clamp spacing exhibited by the tool with different numbers of spacers inserted differ from one another.

Example 8. The tool of any one of Examples 1 through 7 further comprising one or more lower registration surfaces substantially rigidly attached to the tool body so that the clamping portion of the clamp extends upward beyond the one or more lower registration surfaces, the one or more lower registration surfaces being structurally arranged so as to engage a lower edge of a lower siding board received between the clamping portion of the clamp and the rear board engagement surface, so that a distance between the one or more upper registration surfaces and the one or more lower registration surfaces corresponds to a reveal distance between the engaged lower edge of the lower siding board and a lower edge of an upper siding board engaged with and supported by the one or more upper registration surfaces.

Example 9. The tool of any one of Examples 1 through 8 wherein the upper support member is attached to the tool body so as to maintain only a single substantially fixed position of the upper registration surfaces relative to the tool body and the clamp.

Example 10. The tool of any one of Examples 1 through 8 wherein the upper support member is attached to the tool body so as to permit selection or adjustment of a position, among multiple different positions, of the upper registration surfaces relative to the tool body and the clamp.

Example 11. The tool of Example 10 wherein one or both of the tool body or the upper support member includes mating holes with fasteners or pins, a longitudinal rail or slot, mating teeth, mating tabs and slots, or one or more support spacers insertable between the tool body and the upper support member or within the upper support member.

Example 12. The tool of Example 10 wherein the tool body and the upper support member include mating teeth, engagement of the mating teeth retains the upper support members at a selected substantially fixed position relative to the tool body, and one or both of the tool body or the upper support member includes a locking mechanism structurally arranged for engaging the mating teeth at the selected position.

Example 13. The tool of any one of Examples 1 through 12 further comprising an upper board retainer attached to the upper support member, extending upward from the one or more upper registration surfaces, and structurally arranged so as to engage a front surface of an upper siding board positioned with a lower edge thereof on the one or more upper registration surfaces.

Example 14. The tool of Example 13 wherein the upper board retainer is substantially rigidly attached to the upper support member in only a single position.

Example 15. The tool of Example 13 wherein (i) the upper board retainer is engaged with and moveable, relative to the upper support member, between an insertion position and a retention position, (ii) in the retention position the upper board retainer engages a front surface of an upper siding board positioned with a lower edge thereof on the one or more upper registration surfaces and urges the upper siding board rearward against a front surface of a lower siding board received between the clamping portion of the clamp and the rear board engagement surface, and (iii) in the insertion position, the upper board retainer is tilted forward relative to the retention position.

Example 16. The tool of Example 15 wherein the upper board retainer includes a retainer lever structurally arranged so that (i) with the upper board retainer in the insertion position, the retainer lever protrudes upward beyond the one or more upper registration surfaces, and (ii) placement of a lower edge of an upper siding board on the upper registration surfaces pushes the retainer lever downward and moves the upper board retainer from the insertion position into the retention position.

Example 17. The tool of Example 16 wherein (i) the upper board retainer includes a retainer lock that engages upon movement of the upper board retainer into the retention position, (ii) engagement of the retainer lock substantially prevents movement of the upper board retainer into the insertion position, (iii) presence of an upper siding board positioned on the upper registration surfaces substantially prevents disengagement of the retainer lock, and (iv) absence of an upper siding board permits disengagement of the retainer lock and movement of the upper board retainer into the insertion position.

Example 18. The tool of any one of Examples 1 through 17 further comprising (i) a clamp lever substantially rigidly attached to the rearward end of the coupling portion of the clamp and extending downward therefrom and (ii) a clamp stop attached to the clamp lever or the tool body and positioned between the clamp lever and the tool body, wherein the clamp lever and the clamp stop are structurally arranged so that movement of the clamp into the clamped arrangement results in engagement of the clamp lever, clamp stop, and tool body with the clamp lever separated from the tool body by a clamp lever spacing.

Example 19. The tool of Example 18 wherein the clamp stop is structurally arranged so as to provide only a single, substantially fixed clamp lever spacing.

Example 20. The tool of Example 18 wherein the clamp stop is structurally arranged so as to permit selection or adjustment of the clamp lever spacing among multiple different clamp lever spacings.

Example 21. The tool of any one of Examples 1 through 20 wherein the tool body and the coupling portion of the clamp are structurally arranged so as to substantially prevent lateral movement or rotation of the clamp relative to the tool body.

Example 22. The tool of any one of Examples 1 through 21 wherein (i) the actuating mechanism includes an actuating lever that is attached to the coupling member of the clamp and rotatable about an actuating lever axis, extends forward from the tool body, includes a cam surface arranged eccentrically with respect to the actuating lever axis, and is engaged at the cam surface with a bearing surface of the tool body, and (ii) rotation of the actuating lever from the non-actuated arrangement to the actuated arrangement engages the cam surface with the bearing surface so as to push the actuating lever rearward, at least partly retract the coupling portion of the clamp into or through the tool body, and force movement of the clamp toward the rear board engagement surface into the clamped arrangement.

Example 23. The tool of Example 22 wherein the bearing surface of the tool body is moveable relative to the tool body among multiple bearing surface positions, and each bearing surface position corresponds to a different one of multiple different clamp spacings.

Example 24. The tool of Example 23 wherein (i) the bearing surface of the tool comprises a surface of a flattened spring member within the tool body with an adjustment screw threaded therethrough at a first end thereof, (ii) the spring member is positioned so that, with the actuating lever in the actuated arrangement, a second end of the spring member and a threaded end of the screw are pressed against an inner surface of the tool body by force exerted by the cam surface engaged with the bearing surface, and (iii) each different length of the threaded end of the adjustment screw between the spring member and the inner surface of the tool body corresponds to a different clamp spacing or a different level of force exerted by the clamp in the clamped arrangement.

Example 25. A method for using the tool of any one of Examples 1 through 24 to install an upper siding board on a wall, the method comprising: (A) with the rear board engagement surface facing a front surface of a lower siding board already installed on the wall, and with the actuating mechanism in the non-actuated arrangement, inserting the clamping portion of the clamp behind a lower edge of the lower siding board so that the lower siding board is received between the clamping portion of the clamp and the rear board engagement surface; (B) moving the actuating mechanism from the non-actuated arrangement to the actuated arrangement, thereby moving the clamp into the clamped arrangement to clamp the tool onto the lower siding board; (C) positioning the upper siding board with a lower edge thereof on the one or more upper registration surfaces with a lower portion of a rear surface thereof against an upper portion of a front surface of the lower siding board; (D) with the upper siding board supported by the one or more upper registration surfaces of the tool, fastening the upper siding board to the wall; (E) moving the actuating mechanism from the actuated position to the non-actuated position, thereby releasing the tool from the lower siding board; and (F) removing the tool from the lower siding board.

Example 26. The method of Example 25 further comprising, using a second substantially identical tool, performing parts (A) through (F) using the two tools positioned at or near corresponding opposite ends of the lower siding board.

Example 27. The method of any one of Examples 25 or 26 further comprising, after performing parts (A) through (F) to install a first upper siding board on the wall, repeating parts (A) through (F) to install a second upper siding board on the wall with the installed first upper siding board acting as the lower siding board.

Example 28. The method of any one of Examples 25 through 27 for using the tool of any one of Examples 6 through 24, the method further comprising, before performing part (A) for a first time, adjusting the clamp spacing to accommodate a thickness of the lower siding board.

Example 29. The method of any one of Examples 25 through 28 for using the tool of any one of Examples 8 through 24, the method further comprising, while performing part (A), engaging the one or more lower registration surfaces with a lower edge of the lower siding board.

Example 30. The method of any one of Examples 25 through 29 for using the tool of any one of Examples 10 through 24, the method further comprising, before performing part (A) for a first time, selecting or adjusting the position of the one or more upper registration surfaces relative to the tool body and the clamp, thereby setting a reveal spacing for the installed lower siding board.

Example 31. The method of any one of Examples 25 through 30 for using the tool of any one of Examples 15 through 24, the method further comprising, before performing part (C), moving the upper board retainer to the insertion position.

Example 32. The method of any one of Examples 25 through 31 for using the tool of any one of Examples 20 through 24, the method further comprising, before performing part (C), selecting or adjusting the clamp lever spacing to more securely clamp the tool onto the lower siding board.

Example 33. The method of any one of Examples 25 through 32 for using the tool of Example 23, the method further comprising, before performing part (C), moving the bearing surface to a bearing surface position that results in more secure clamping of the tool onto the lower siding board.

Example 34. The method of any one of Examples 25 through 32 for using the tool of Example 24, the method further comprising, before performing part (C), turning the adjustment screw to adjust the length of the threaded end thereof so as to move the bearing surface of the spring member to a bearing surface position that results in more secure clamping of the tool onto the lower siding board.

It is intended that equivalents of the disclosed example embodiments and methods shall fall within the scope of the present disclosure or appended claims. It is intended that the disclosed example embodiments and methods, and equivalents thereof, may be modified while remaining within the scope of the present disclosure or appended claims.

In the foregoing Detailed Description, various features may be grouped together in several example embodiments for the purpose of streamlining the disclosure. This method of disclosure is not to be interpreted as reflecting an intention that any claimed embodiment requires more features than are expressly recited in the corresponding claim. Rather, as the appended claims reflect, inventive subject matter may lie in less than all features of a single disclosed example embodiment. Therefore the present disclosure shall be construed as implicitly disclosing any embodiment having any suitable subset of one or more features—which features are shown, described, or claimed in the present application—including those subsets that may not be explicitly disclosed herein. A "suitable" subset of features includes only features that are neither incompatible nor mutually exclusive with respect to any other feature of that subset. Accordingly, the appended claims are hereby incorporated into the Detailed Description, with each claim standing on its own as a separate disclosed embodiment. In addition, each of the appended dependent claims shall be interpreted, only for purposes of disclosure by said incorporation of the claims into the Detailed Description, as if written in multiple dependent form and dependent upon all preceding claims with which it is not inconsistent. It should be further noted that the cumulative scope of the appended claims can, but does not necessarily, encompass the whole of the subject matter disclosed in the present application.

The following interpretations shall apply for purposes of the present disclosure and appended claims. The article "a" shall be interpreted as "one or more" unless "only one," "a single," or other similar limitation is stated explicitly or is implicit in the particular context; similarly, the article "the" shall be interpreted as "one or more of the" unless "only one of the," "a single one of the," or other similar limitation is stated explicitly or is implicit in the particular context. The conjunction "or" is to be construed inclusively (e.g., "a dog or a cat" would be interpreted as "a dog, or a cat, or both"; e.g., "a dog, a cat, or a mouse" would be interpreted as "a dog, or a cat, or a mouse, or any two, or all three"), unless: (i) it is explicitly stated otherwise, e.g., by use of "either . . . or," "only one of," or similar language; or (ii) two or more of the listed alternatives are mutually exclusive within the particular context, in which case "or" would encompass only those combinations involving non-mutually-exclusive alternatives. Similarly, "one or more of a dog or a cat" would be interpreted as including (i) one or more dogs without any cats, (ii) one or more cats without any dogs, or (iii) one or more dogs and one or more cats, unless explicitly stated otherwise or the alternatives are understood or disclosed (implicitly or explicitly) to be mutually exclusive or incompatible. Similarly, "one or more of a dog, a cat, or a mouse" would be interpreted as (i) one or more dogs without any cats or mice, (ii) one or more cats without and dogs or mice, (iii) one or more mice without any dogs or cats, (iv) one or more dogs and one or more cats without any mice, (v) one or more dogs and one or more mice without any cats, (vi) one or more cats and one or more mice without any dogs, or (vii) one or more dogs, one or more cats, and one or more mice. "Two or more of a dog, a cat, or a mouse" would be interpreted as (i) one or more dogs and one or more cats without any mice, (ii) one or more dogs and one or more mice without any cats, (iii) one or more cats and one or more mice without and dogs, or (iv) one or more dogs, one or more cats, and one or more mice; "three or more," "four or more," and so on would be analogously interpreted. For any of the preceding recitations, if any pairs or combinations of the included alternatives are understood or disclosed (implicitly or explicitly) to be incompatible or mutually exclusive, such pairs or combinations are understood to be excluded from the corresponding recitation. For purposes of the present disclosure and appended claims, the words "comprising," "including," "having," and variants thereof, wherever they appear, shall be construed as open ended terminology, with the same meaning as if a phrase such as "at least" were appended after each instance thereof, unless explicitly stated otherwise.

For purposes of the present disclosure or appended claims, when terms are employed such as "about equal to," "substantially equal to," "greater than about," "less than about," and so forth, in relation to a numerical quantity, standard conventions pertaining to measurement precision and significant digits shall apply, unless a differing interpretation is explicitly set forth. For null quantities described by phrases such as "substantially prevented," "substantially absent," "substantially eliminated," "about equal to zero," "negligible," and so forth, each such phrase shall denote the case wherein the quantity in question has been reduced or diminished to such an extent that, for practical purposes in the context of the intended operation or use of the disclosed or claimed apparatus or method, the overall behavior or performance of the apparatus or method does not differ from that which would have occurred had the null quantity in fact been completely removed, exactly equal to zero, or otherwise exactly nulled.

For purposes of the present disclosure and appended claims, any labelling of elements, steps, limitations, or other portions of an embodiment, example, or claim (e.g., first, second, third, etc., (a), (b), (c), etc., or (i), (ii), (iii), etc.) is only for purposes of clarity, and shall not be construed as implying any sort of ordering or precedence of the portions so labelled. If any such ordering or precedence is intended, it will be explicitly recited in the embodiment, example, or claim or, in some instances, it will be implicit or inherent based on the specific content of the embodiment, example, or claim. In the appended claims, if the provisions of 35 USC § 112(*f*) are desired to be invoked in an apparatus claim, then the word "means" will appear in that apparatus claim. If those provisions are desired to be invoked in a method claim, the words "a step for" will appear in that method claim. Conversely, if the words "means" or "a step for" do not appear in a claim, then the provisions of 35 USC § 112(*f*) are not intended to be invoked for that claim.

If any one or more disclosures are incorporated herein by reference and such incorporated disclosures conflict in part or whole with, or differ in scope from, the present disclosure, then to the extent of conflict, broader disclosure, or broader definition of terms, the present disclosure controls. If such incorporated disclosures conflict in part or whole with one another, then to the extent of conflict, the later-dated disclosure controls.

The Abstract is provided as required as an aid to those searching for specific subject matter within the patent literature. However, the Abstract is not intended to imply that any elements, features, or limitations recited therein are necessarily encompassed by any particular claim. The scope of subject matter encompassed by each claim shall be determined by the recitation of only that claim.

What is claimed is:

1. A tool comprising:

(a) a tool body having a rear board engagement surface;

(b) an upper support member attached to and extending upward from the tool body and having one or more upper registration surfaces;

(c) a clamp engaged with and movable, relative to the tool body, between a clamped arrangement and an unclamped arrangement, the clamp including (i) a coupling portion engaged with and extending rearward from the tool body, (ii) a clamping portion substantially rigidly attached to a rearward end of the coupling portion and extending upward therefrom spaced apart from the rear board engagement surface of the tool body, and (iii) a clamp lever substantially rigidly attached to the rearward end of the coupling portion and extending downward therefrom;

(d) a clamp stop attached to the clamp lever or the tool body and positioned between the clamp lever and the tool body; and (e) an actuating mechanism (i) coupled to the tool body and the clamp and (ii) movable between an actuated arrangement and a non-actuated arrangement, wherein:

(f) with the clamp in the clamped arrangement, the tool is characterized by a clamp spacing between the rear board engagement surface and the clamping portion of the clamp;

(g) the one or more upper registration surfaces are structurally arranged so as to engage and support a lower edge of an upper siding board that is positioned on the one or more upper registration surfaces with a lower portion of a rear surface the upper siding board facing an upper portion of a front surface of a lower siding board received between the clamping portion of the clamp and the rear board engagement surface;

(h) the tool body, the clamp, and the actuating mechanism are structurally arranged so that (i) movement of the actuating mechanism from the non-actuated arrangement to the actuated arrangement at least partly retracts the coupling portion into or through the tool body and thereby forces movement of the clamp toward the rear board engagement surface into the clamped arrangement, (ii) in the actuated arrangement, the actuating mechanism retains the clamp in the clamped arrangement, and (iii) in the non-actuated arrangement, the actuating mechanism permits movement of the clamp into the non-clamped arrangement; and (i) the clamp lever and the clamp stop are structurally arranged so that movement of the clamp into the clamped arrangement results in engagement of the clamp lever, clamp stop, and tool body with the clamp lever separated from the tool body by a clamp lever spacing.

2. The tool of claim 1 wherein the tool body and the clamp are structurally arranged so that, with the lower siding board received between the clamping portion of the clamp and the rear board engagement surface, movement of the clamp into the clamped arrangement results in the clamping portion being urged against a rear surface of the lower siding board which in turn urges the front surface of the lower siding board against the rear board engagement surface, thereby securing the tool to the lower siding board.

3. The tool of claim 2 further comprising one or more protruding teeth on a front surface of the clamping portion of the clamp, the one or more teeth being structurally arranged so that, with the clamping portion urged against the rear surface of the lower siding board, the one or more teeth indent or penetrate the rear surface of the lower siding board.

4. The tool of claim 3 wherein an upper edge of the clamping portion of the clamp is beveled or each one of the one or more protruding teeth is wedged so as to facilitate insertion of the clamping portion and the one or more protruding teeth behind the lower siding board.

5. The tool of claim 1 wherein one or more of the tool body, the clamp, or the actuating mechanism are structurally arranged so as to enable adjustment of the clamp spacing.

6. The tool of claim 5 further comprising one or more clamp spacers that are insertable between the coupling and clamping portions of the clamp and structurally arranged so that the clamp spacing exhibited by the tool with one clamp spacer inserted differs from the clamp spacing exhibited by the tool with the clamp spacer absent, and clamp spacing exhibited by the tool with different numbers of spacers inserted differ from one another.

7. A method for using the tool of claim 5 to install the upper siding board on a wall, the method comprising:

(A) first, adjusting the clamp spacing to accommodate a thickness of the lower siding board;

(B) with the rear board engagement surface facing the front surface of the lower siding board that is already installed on the wall, and with the actuating mechanism in the non-actuated arrangement, inserting the clamping portion of the clamp behind a lower edge of the lower siding board so that the lower siding board is received between the clamping portion of the clamp and the rear board engagement surface;

(C) moving the actuating mechanism from the non-actuated arrangement to the actuated arrangement, thereby moving the clamp into the clamped arrangement to clamp the tool onto the lower siding board;

(D) positioning the upper siding board with the lower edge thereof on the one or more upper registration surfaces with the lower portion of the rear surface thereof against the upper portion of the front surface of the lower siding board;

(E) with the upper siding board supported by the one or more upper registration surfaces of the tool, fastening the upper siding board to the wall;

(F) moving the actuating mechanism from the actuated position to the non-actuated position, thereby releasing the tool from the lower siding board; and (G) removing the tool from the lower siding board.

8. The tool of claim 1 further comprising one or more lower registration surfaces substantially rigidly attached to the tool body so that the clamping portion of the clamp extends upward beyond the one or more lower registration surfaces, the one or more lower registration surfaces being structurally arranged so as to engage a lower edge of the lower siding board received between the clamping portion of the clamp and the rear board engagement surface, so that a distance between the one or more upper registration surfaces and the one or more lower registration surfaces corresponds to a reveal distance between the engaged lower edge of the lower siding board and the lower edge of the upper siding board engaged with and supported by the one or more upper registration surfaces.

9. A method for using the tool of claim 8 to install the upper siding board on a wall, the method comprising:

(A) with the rear board engagement surface facing the front surface of the lower siding board that is already installed on the wall, and with the actuating mechanism in the non-actuated arrangement, inserting the clamping portion of the clamp behind the lower edge of the lower siding board so that the lower siding board is received between the clamping portion of the clamp and the rear board engagement surface, and engaging the one or more lower registration surfaces with the lower edge of the lower siding board;

(B) moving the actuating mechanism from the non-actuated arrangement to the actuated arrangement, thereby moving the clamp into the clamped arrangement to clamp the tool onto the lower siding board;

(C) positioning the upper siding board with the lower edge thereof on the one or more upper registration surfaces with the lower portion of the rear surface thereof against the upper portion the front surface of the lower siding board;

(D) with the upper siding board supported by the one or more upper registration surfaces of the tool, fastening the upper siding board to the wall;

(E) moving the actuating mechanism from the actuated position to the non-actuated position, thereby releasing the tool from the lower siding board; and (F) removing the tool from the lower siding board.

10. The tool of claim 1 wherein the upper support member is attached to the tool body so as to permit selection or adjustment of a position, among multiple different positions, of the upper registration surfaces relative to the tool body and the clamp.

11. The tool of claim 10 wherein one or both of the tool body or the upper support member includes mating holes, a longitudinal rail or slot, mating teeth, or one or more support spacers insertable between the tool body and the upper support member or within the upper support member.

12. A method for using the tool of claim 10 to install the upper siding board on a wall, the method comprising:

(A) first, selecting or adjusting the position of the one or more upper registration surfaces relative to the tool body and the clamp, thereby setting a reveal spacing for the lower siding board;

(B) with the rear board engagement surface facing the front surface of the lower siding board that is already installed on the wall, and with the actuating mechanism in the non-actuated arrangement, inserting the clamping portion of the clamp behind a lower edge of the lower siding board so that the lower siding board is received between the clamping portion of the clamp and the rear board engagement surface;

(C) moving the actuating mechanism from the non-actuated arrangement to the actuated arrangement, thereby moving the clamp into the clamped arrangement to clamp the tool onto the lower siding board;

(D) positioning the upper siding board with the lower edge thereof on the one or more upper registration surfaces with the lower portion of the rear surface thereof against the upper portion of the front surface of the lower siding board;

(E) with the upper siding board supported by the one or more upper registration surfaces of the tool, fastening the upper siding board to the wall;

(F) moving the actuating mechanism from the actuated position to the non-actuated position, thereby releasing the tool from the lower siding board; and (G) removing the tool from the lower siding board.

13. The tool of claim 1 further comprising an upper board retainer attached to the upper support member, extending upward from the one or more upper registration surfaces, and structurally arranged so as to engage a front surface of the upper siding board positioned with the lower edge thereof on the one or more upper registration surfaces.

14. The tool of claim 13 wherein (i) the upper board retainer is engaged with and moveable, relative to the upper support member, between an insertion position and a retention position, (ii) in the retention position the upper board retainer engages the front surface of the upper siding board positioned with the lower edge thereof on the one or more upper registration surfaces and urges the upper siding board rearward against the front surface of the lower siding board received between the clamping portion of the clamp and the rear board engagement surface, and (iii) in the insertion position, the upper board retainer is tilted forward relative to the retention position.

15. The tool of claim 14 wherein the upper board retainer includes a retainer lever structurally arranged so that (i) with the upper board retainer in the insertion position, the retainer lever protrudes upward beyond the one or more upper registration surfaces, and (ii) placement of the lower edge of the upper siding board on the upper registration surfaces pushes the retainer lever downward and moves the upper board retainer from the insertion position into the retention position.

16. The tool of claim 15 wherein (i) the upper board retainer includes a retainer lock that engages upon movement of the upper board retainer into the retention position, (ii) engagement of the retainer lock substantially prevents movement of the upper board retainer into the insertion position, (iii) presence of the upper siding board positioned on the upper registration surfaces substantially prevents disengagement of the retainer lock, and (iv) absence of the upper siding board permits disengagement of the retainer lock and movement of the upper board retainer into the insertion position.

17. A method for using the tool of claim 14 to install the upper siding board on a wall, the method comprising:

(A) with the rear board engagement surface facing the front surface of the lower siding board that is already installed on the wall, and with the actuating mechanism in the non-actuated arrangement, inserting the clamping portion of the clamp behind a lower edge of the lower siding board so that the lower siding board is received between the clamping portion of the clamp and the rear board engagement surface;

(B) moving the actuating mechanism from the non-actuated arrangement to the actuated arrangement, thereby moving the clamp into the clamped arrangement to clamp the tool onto the lower siding board;

(C) moving the upper board retainer to the insertion position;

(D) with the upper board retainer in the insertion position, positioning the upper siding board with the lower edge thereof on the one or more upper registration surfaces with the lower portion of the rear surface thereof against the upper portion of the front surface of the lower siding board;

(E) with the upper siding board supported by the one or more upper registration surfaces of the tool, fastening the upper siding board to the wall;

(F) moving the actuating mechanism from the actuated position to the non-actuated position, thereby releasing the tool from the lower siding board; and (G) removing the tool from the lower siding board.

18. The tool of claim 1 wherein the clamp stop is structurally arranged so as to permit selection or adjustment of the clamp lever spacing among multiple different clamp lever spacings.

19. A method for using the tool of claim 18 to install the upper siding board on a wall, the method comprising:

(A) with the rear board engagement surface facing the front surface of the lower siding board that is already installed on the wall, and with the actuating mechanism in the non-actuated arrangement, inserting the clamping portion of the clamp behind a lower edge of the lower siding board so that the lower siding board is received between the clamping portion of the clamp and the rear board engagement surface;

(B) selecting or adjusting the clamp lever spacing to more securely clamp the tool onto the lower siding board, and moving the actuating mechanism from the non-actuated arrangement to the actuated arrangement, thereby moving the clamp into the clamped arrangement to clamp the tool onto the lower siding board;

(C) positioning the upper siding board with the lower edge thereof on the one or more upper registration surfaces with the lower portion of the rear surface thereof against the upper portion of the front surface of the lower siding board;

(D) with the upper siding board supported by the one or more upper registration surfaces of the tool, fastening the upper siding board to the wall;

(E) moving the actuating mechanism from the actuated position to the non-actuated position, thereby releasing the tool from the lower siding board; and (F) removing the tool from the lower siding board.

20. The tool of claim 1 wherein the tool body and the coupling portion of the clamp are structurally arranged so as to substantially prevent lateral movement or rotation of the clamp relative to the tool body.

21. The tool claim 1 wherein (i) the actuating mechanism includes an actuating lever that is attached to the coupling member of the clamp and rotatable about an actuating lever axis, extends forward from the tool body, includes a cam surface arranged eccentrically with respect to the actuating lever axis, and is engaged at the cam surface with a bearing surface of the tool body, and (ii) rotation of the actuating lever from the non-actuated arrangement to the actuated arrangement engages the cam surface with the bearing surface so as to push the actuating lever rearward, at least partly retract the coupling portion of the clamp into or through the tool body, and force movement of the clamp toward the rear board engagement surface into the clamped arrangement.

22. The tool of claim 21 wherein the bearing surface of the tool body is moveable relative to the tool body among multiple bearing surface positions, and each bearing surface position corresponds to a different one of multiple different clamp spacings.

23. The tool of claim 22 wherein (i) the bearing surface of the tool comprises a surface of a flattened spring member within the tool body with an adjustment screw threaded therethrough at a first end thereof, (ii) the spring member is positioned so that, with the actuating lever in the actuated arrangement, a second end of the spring member and a threaded end of the screw are pressed against an inner surface of the tool body by force exerted by the cam surface engaged with the bearing surface, and (iii) each different length of the threaded end of the adjustment screw between the spring member and the inner surface of the tool body corresponds to a different clamp spacing or a different level of force exerted by the clamp in the clamped arrangement.

24. A method for using the tool of claim 23 to install the upper siding board on a wall, the method comprising:

(A) with the rear board engagement surface facing the front surface of the lower siding board that is already installed on the wall, and with the actuating mechanism in the non-actuated arrangement, inserting the clamping portion of the clamp behind a lower edge of the lower siding board so that the lower siding board is received between the clamping portion of the clamp and the rear board engagement surface;

(B) turning the adjustment screw to adjust the length of the threaded end thereof so as to move the bearing surface of the spring member to a bearing surface position that results in more secure clamping of the tool onto the lower siding board, and moving the actuating mechanism from the non-actuated arrangement to the actuated arrangement, thereby moving the clamp into the clamped arrangement to clamp the tool onto the lower siding board;

(C) positioning the upper siding board with the lower edge thereof on the one or more upper registration surfaces with the lower portion of the rear surface thereof against the upper portion of the front surface of the lower siding board;

(D) with the upper siding board supported by the one or more upper registration surfaces of the tool, fastening the upper siding board to the wall;

(E) moving the actuating mechanism from the actuated position to the non-actuated position, thereby releasing the tool from the lower siding board; and (F) removing the tool from the lower siding board.

25. A method for using the tool of claim 22 to install the upper siding board on a wall, the method comprising:

(A) with the rear board engagement surface facing the front surface of the lower siding board that is already installed on the wall, and with the actuating mechanism in the non-actuated arrangement, inserting the clamping portion of the clamp behind a lower edge of the lower siding board so that the lower siding board is received between the clamping portion of the clamp and the rear board engagement surface;

(B) moving the bearing surface to a bearing surface position that results in secure clamping of the tool onto the lower siding board, and moving the actuating mechanism from the non-actuated arrangement to the actuated arrangement, thereby moving the clamp into the clamped arrangement to clamp the tool onto the lower siding board;

(C) positioning the upper siding board with the lower edge thereof on the one or more upper registration surfaces with the lower portion of the rear surface thereof against the upper portion of the front surface of the lower siding board;

(D) with the upper siding board supported by the one or more upper registration surfaces of the tool, fastening the upper siding board to the wall;

(E) moving the actuating mechanism from the actuated position to the non-actuated position, thereby releasing the tool from the lower siding board; and (F) removing the tool from the lower siding board.

26. A method for using the tool of claim 1 to install the upper siding board on a wall, the method comprising:

(A) with the rear board engagement surface facing the front surface of the lower siding board already installed on the wall, and with the actuating mechanism in the non-actuated arrangement, inserting the clamping portion of the clamp behind a lower edge of the lower siding board so that the lower siding board is received between the clamping portion of the clamp and the rear board engagement surface;

(B) moving the actuating mechanism from the non-actuated arrangement to the actuated arrangement, thereby moving the clamp into the clamped arrangement to clamp the tool onto the lower siding board;

(C) positioning the upper siding board with the lower edge thereof on the one or more upper registration surfaces with the lower portion of the rear surface thereof against the upper portion of the front surface of the lower siding board;

(D) with the upper siding board supported by the one or more upper registration surfaces of the tool, fastening the upper siding board to the wall;

(E) moving the actuating mechanism from the actuated position to the non-actuated position, thereby releasing the tool from the lower siding board; and (F) removing the tool from the lower siding board.

27. The method of claim 26 further comprising, using a second substantially identical tool, performing parts (A) through (F) using the tool and the second substantially identical tool positioned along the lower siding board.

28. The method of claim 26 further comprising, after performing parts (A) through (F) to install a first upper siding board on the wall, repeating parts (A) through (F) to install a second upper siding board on the wall with the first upper siding board acting as the lower siding board.

* * * * *